US009700480B2

(12) United States Patent
Fiore

(10) Patent No.: US 9,700,480 B2
(45) Date of Patent: Jul. 11, 2017

(54) INSTRUMENT FOR THE MASSAGE AND MOBILIZATION OF THE SOFT TISSUE OF THE HUMAN BODY

(71) Applicant: Russell D. Fiore, Lincoln, RI (US)

(72) Inventor: Russell D. Fiore, Lincoln, RI (US)

( * ) Notice: Subject to any disclaimer, the term of this patent is extended or adjusted under 35 U.S.C. 154(b) by 433 days.

(21) Appl. No.: 13/999,728

(22) Filed: Mar. 18, 2014

(65) Prior Publication Data

US 2015/0265486 A1 Sep. 24, 2015

(51) Int. Cl.
*A61H 7/00* (2006.01)
*A61H 15/00* (2006.01)

(52) U.S. Cl.
CPC ..... *A61H 7/003* (2013.01); *A61H 7/00* (2013.01); *A61H 7/002* (2013.01); *A61H 7/007* (2013.01); *A61H 15/0092* (2013.01); *A61H 2015/0014* (2013.01); *A61H 2015/0042* (2013.01); *A61H 2201/0153* (2013.01); *A61H 2201/0157* (2013.01); *A61H 2201/0192* (2013.01); *A61H 2201/1253* (2013.01); *A61H 2201/1695* (2013.01)

(58) Field of Classification Search
CPC .... A61H 2201/0157; A61H 2201/1253; A61H 2201/1692; A61H 2205/10; A61H 2205/108; A61H 7/00; A61H 7/001; A61H 7/007; A61H 7/002; A61H 7/003; A61H 7/004; A61H 7/008; A61H 15/00; A61H 2015/0007; A61H 2015/0042; A61H 2015/005; A61H 2015/0064; A61H 15/0078; A61H 15/02; A61H 2201/1695; A61H 2201/10; A61H 2201/168
USPC ..... D24/211–215; 601/134; 606/201
See application file for complete search history.

(56) References Cited

U.S. PATENT DOCUMENTS 1,611,811 A * 12/1926 Brickey ..... A61H 15/0092 601/120
1,731,900 A * 10/1929 Jordan ..... A61H 15/0092 601/120
1,882,490 A * 10/1932 Falck ..... A61H 15/0092 492/36
2,014,293 A * 9/1935 Riley ..... A46B 5/06 15/222
D201,598 S * 7/1965 Gaspar ..... D24/211
3,424,150 A * 1/1969 Meranto ..... A61H 11/00 15/110
4,002,163 A * 1/1977 Jackson, Jr. ..... A61H 15/0092 601/120
4,345,757 A * 8/1982 Lo Voi ..... A61H 15/0092 482/132
5,230,679 A * 7/1993 Olsen ..... A61H 1/0237 482/114
5,514,058 A * 5/1996 Buoni ..... A63B 21/0004 482/124

(Continued)

OTHER PUBLICATIONS

Fiore—A 3 pg. summary of prior art devices presently used in the trade and included in applicants provisional appln. These 3 pgs are attached.

*Primary Examiner* — Justine Yu
*Assistant Examiner* — Tu Vo
(74) *Attorney, Agent, or Firm* — Robert J Doherty

(57) ABSTRACT

An instrument for massaging human body portions having an elongated rod-like body having multiple treatment edges upwardly extending therefrom and bendable into a wide variety of U-shaped configurations.

8 Claims, 5 Drawing Sheets

(56) References Cited

U.S. PATENT DOCUMENTS

| | | | | |
|---|---|---|---|---|
| 5,649,884 | A * | 7/1997 | Manalo | A61H 7/00 138/115 |
| 5,741,219 | A * | 4/1998 | Schweisfurth | A61H 15/0092 601/119 |
| 6,135,972 | A * | 10/2000 | Kuo | A61H 15/0092 601/119 |
| 6,193,637 | B1 * | 2/2001 | Corbin | A63B 21/012 446/120 |
| 6,764,456 | B1 * | 7/2004 | Doherty | A61H 15/00 601/118 |
| 2004/0082449 | A1 * | 4/2004 | Brown, Jr. | A63B 21/026 482/140 |
| 2005/0202944 | A1 * | 9/2005 | Deal | A61H 15/0092 482/126 |
| 2006/0211551 | A1 * | 9/2006 | Mandell | A63B 21/00043 482/121 |
| 2012/0122635 | A1 * | 5/2012 | Tsai | A61H 15/00 482/132 |
| 2012/0310125 | A1 * | 12/2012 | Hall | A61H 15/0085 601/120 |
| 2013/0096472 | A1 * | 4/2013 | Bertram | A61H 15/0092 601/120 |
| 2013/0158455 | A1 * | 6/2013 | Ruschmeyer | A61H 15/00 601/118 |
| 2015/0025568 | A1 * | 1/2015 | Liu | A61H 39/04 606/204 |
| 2015/0045707 | A1 * | 2/2015 | Selvaggio | A61H 15/0092 601/118 |

* cited by examiner

INSTRUMENT FOR THE MASSAGE AND MOBILIZATION OF THE SOFT TISSUE OF THE HUMAN BODY

This application claims the benefit of U.S. Provisional Patent Application No. 61/852,958 filed Mar. 25, 2013.

BACKGROUND OF THE INVENTION

This invention deals with the massage and mobilization of the soft body tissue of the bodies of human and similar species. The invention has special use in the treatment of soft tissue injuries common with athletic activity although not limited thereto. When the soft body tissue of a human is subjected to trauma, overuse, etc., the connective tissue (fascia) underlying the skin may be affected, and this and other reasons can cause inelastic fibrous adhesions between the layers of the myofascial system that prevent normal muscle mechanics and decrease soft tissue extensibility and can lead to further injury. Historically, the treatment of such aforementioned conditions is by hand manipulation and massage of the affected soft tissue area by a clinician such as an athletic trainer, etc. by either using his/her hands or manipulating various rigid tools or instruments having fixed straight edges or curvatures shaped to conform to different parts of the body. Such tools can increase the mechanical advantage for the clinician and can reduce the stress on the clinician's hands—however, this approach requires the purchase of variously sized instruments to conform to the different areas of the body as well as bodies of various sizes.

Many different hand held instruments are available for use to assist with soft tissue mobilization. These instruments are available in different shapes and sizes and are constructed from different materials including plastic, bone, ceramic and stainless steel. When using an instrument, the clinician must choose an instrument with a shape that is compatible to the area being treated. If the forearm, which is convex, were being treated, a concave instrument could be used that matches the shape of the forearm. This would result in uniform pressure over the soft tissue. If a flat or convex instrument were used to treat the forearm, less tissue area would be treated with each stroke of the instrument; and if the clinician used the same pressure as with the concave instrument, a greater overall pressure would be put on the tissue being treated. A concave instrument with a curve that is greater than that of the forearm would result in pressure only on the lateral edges of the forearm without contact in the center and should not be used.

Accordingly, it would be desirable to have a single instrument that provides the advantages of a device that would provide the desired mechanical advantage for the clinician to reduce the strain on the clinician's hands common in hand manipulation yet provides the possibility of a large number of shaped surfaces for engaging the differently shaped areas of the patient's body. A further desirable feature would be the provision of such a single instrument which is of simple, relatively low cost construction and which does not require a dedicated inventory and carrying kit.

These and other objects of the invention are accomplished by the provision of an instrument hand manipulable by a clinician for the mobilization and massage of the soft tissue of the human body, said instrument comprising an elongated generally straight rod-like body having opposite terminal first and second ends, said body having at least one longitudinally extending treatment edge, said body formed of a relatively flexible material such that the body may be bent to a generally U-shaped configuration bend when said ends are grasped and downwardly bent by the clinician such that said bend conforms to the configuration of the body part being manipulated such that said at least one treatment edge contacts said body part which subsequently may be massaged by the movement of the instrument across the body part surface by the clinician.

Other objects, features and advantages of the invention shall become apparent as the description thereof proceeds when considered in connection with the accompanying illustrative drawings.

DESCRIPTION OF THE DRAWINGS

In the drawings that illustrate the best mode presently contemplated for carrying out the present invention.

DESCRIPTION OF THE INVENTION

Figure 1:
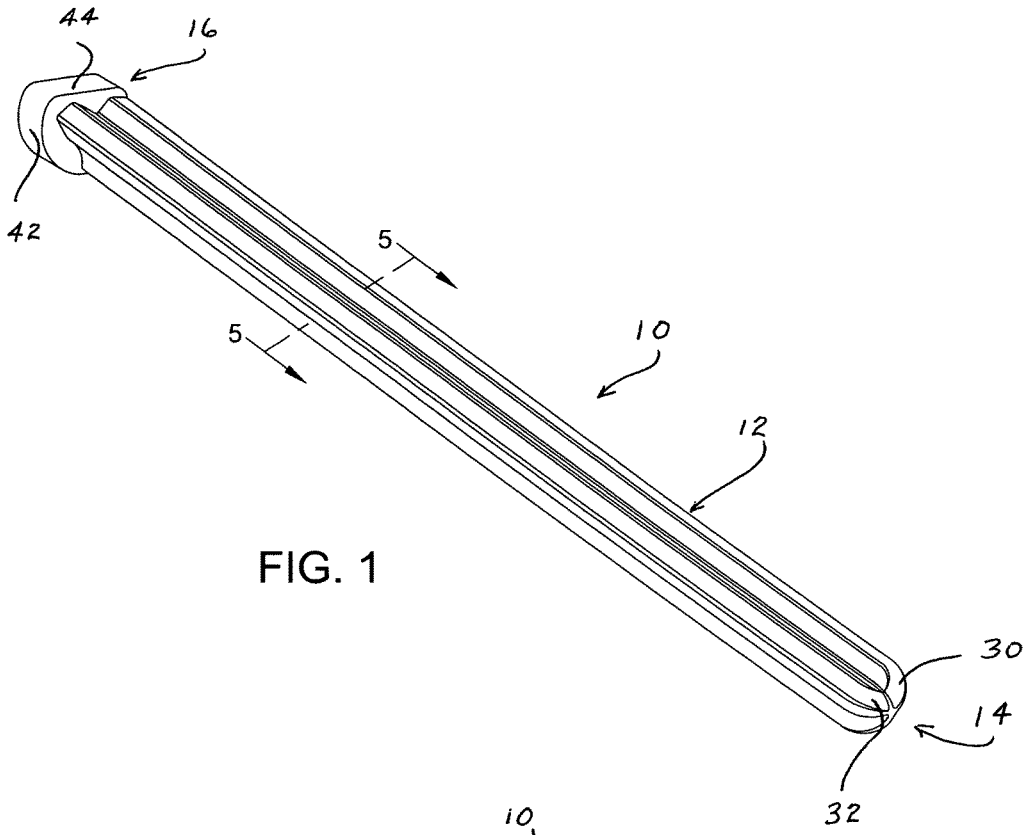
FIG. 1 is a front perspective view of one form of the instrument of the present invention.
Figure 2:
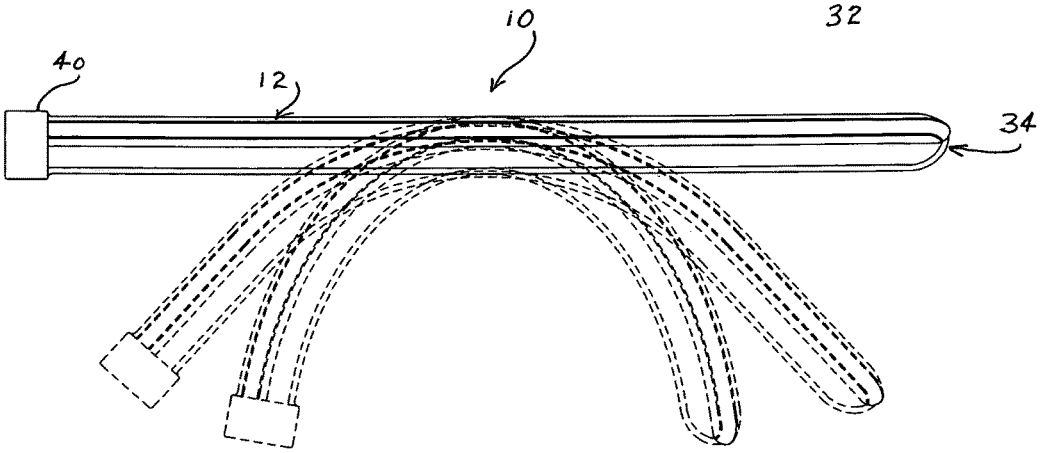
FIG. 2 is a front elevational view of FIG. 1 and showing in broken lines the manner in which the instrument may be bent to various shapes to better match the profile of the body part to be manipulated.
Figure 3:
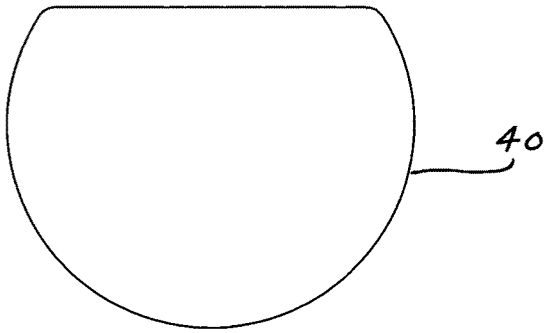
FIG. 3 is a left side elevational view of FIG. 1.
Figure 4:
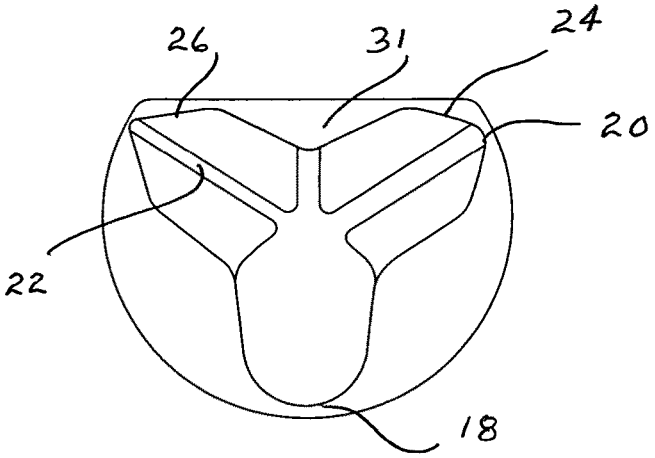
FIG. 4 is a right side elevational view of FIG. 1.
Figure 5:
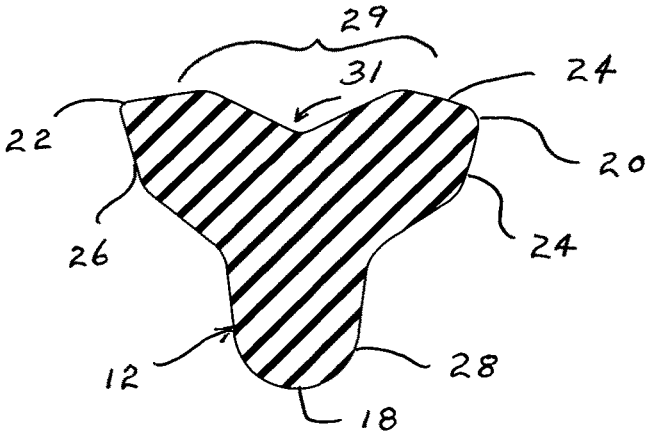
FIG. 5 is a sectional view along the line 5-5 of FIG. 1.

Referring to the drawings and more particularly to FIGS. 1-5, the instrument or device 10 of the present invention is depicted and comprises an elongated body 12 having first and second terminal ends 14 and 16 respectively. The body 12 is preferably formed of a polyurethane elastomeric rubber material having a durometer from 60 to 100 A so as to provide a somewhat elastic relatively high frictional surface contact with the skin surface of the patient as the body 12 is moved along and/or back and forth across the skin surface coupled with a downward inward pressure thereon in the intended manner. A suitable material for construction of the body 12 is Vibrathane® 6060 available from Polyurethane Products Corporation under the trade name Die-Thane. Such material enables the rod-like body 12 to be bent by the clinician into a wide variety of generally U-shaped bends as shown by FIG. 2 to shape the central area 13 of the body 12 to conform to the surface of the particular body part of the patient being treated.

The body 12 includes at least one and preferable three treatment edges 18, 20 and 22 extending upwardly in profile from the body and extending longitudinally therealong between the ends 14 and 16. These edges 18, 20 and 22 are of varied cross-sectional configurations to, in effect, provide the clinician with a wide range of treatment tools to affect various treatment procedures. A first treatment edge 18 is of a dull rounded configuration while the second edge 20 is more pointed, e.g., a 0.062 inch chamfer, and the third edge 22 shaped still with an approximately 0.032 inch chamfer. In other words, there are chamfered surfaces 24 and 26 and transitional areas 28 upstanding from the surface of the body 12 which cooperate to form the edges 20, 22 and 18 respectively. The treatment edges 18, 20 and 22 are preferably circumferentially disposed about the body 12 and are separated from each other in equal areas of approximately 120 degrees. It should also be pointed out that there is an area 29 formed by the connection of chamfered surfaces 28 and 26 that is relatively flat (with an intermediate depression 31) which can also be used as a treatment surface.

The edges 18, 20 and 22 each merge into rounded terminal end edge portions 30, 32 and 34 to cooperatively form a smooth rounded configuration to the first end 14 that along with the terminal edge end portions 30, 32 and 34 may be utilized by the clinician to reach areas of the patient's body not readily accessible to the central area 13 of the body 12. The opposite second end 16 is preferably provided with a cylindrical or cylindrical knob or disc 40 having an outer rounded treatment surface 42 and a flat treatment surface 44. The surface 44 may also be utilized as a platform by which the clinician may apply pressure to the knob 40 via his/her finger and/or thumb.

Figure 6:
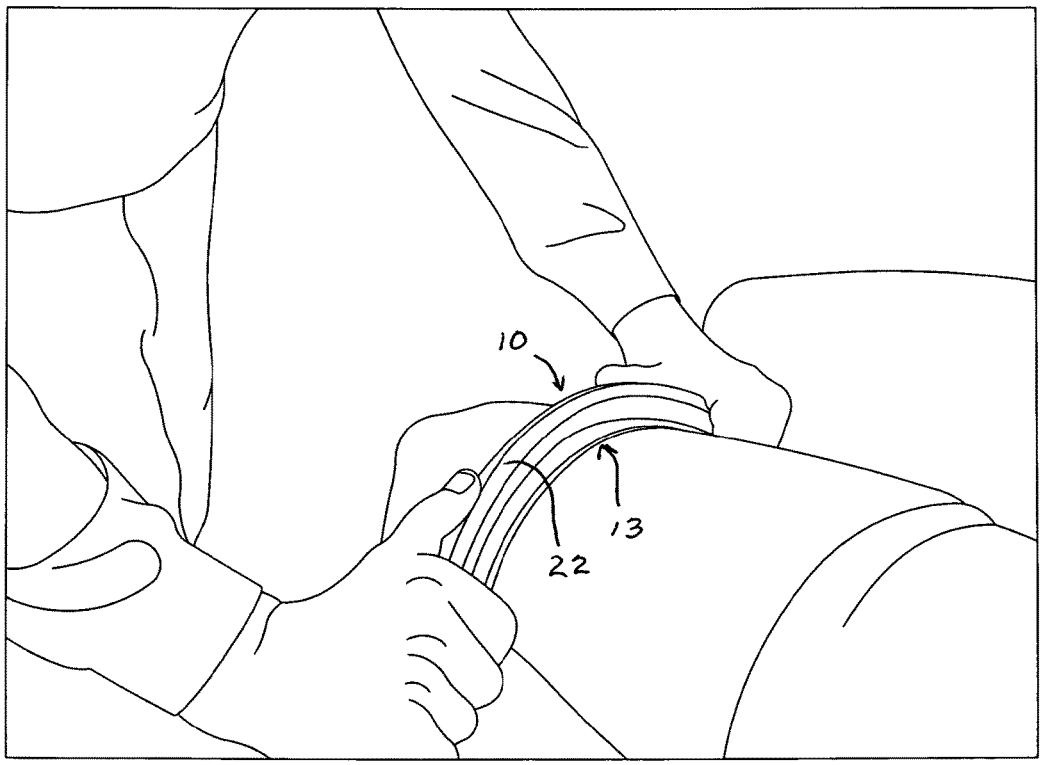
FIG. 6 is a perspective view of a clinician holding the instrument in a bent attitude to conform to the body profile of a patient's thigh preparatory to massaging.
Figure 7:
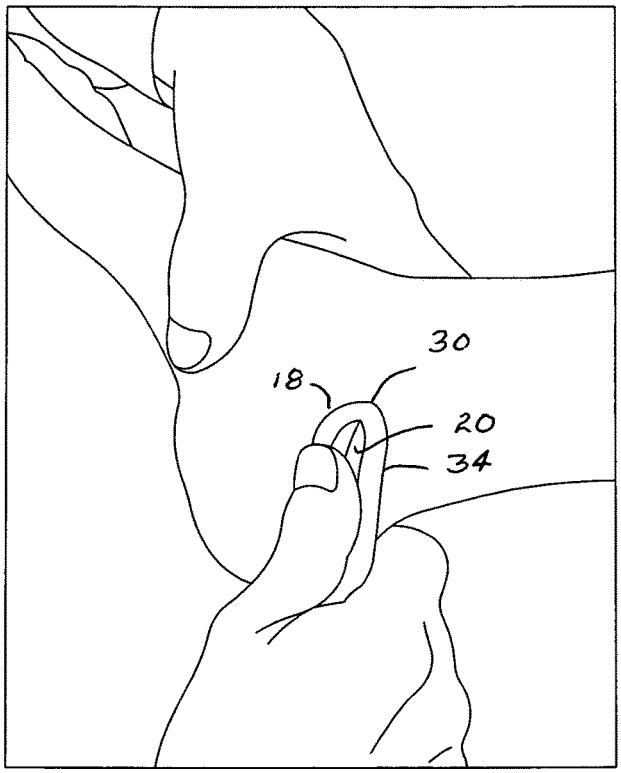
FIG. 7 is a perspective view of a clinician holding and end portion of the instrument and pressing the rounded end thereof against a patient's ankle to demonstrate use with a thin body tissue area of a patient's body.
Figure 8:
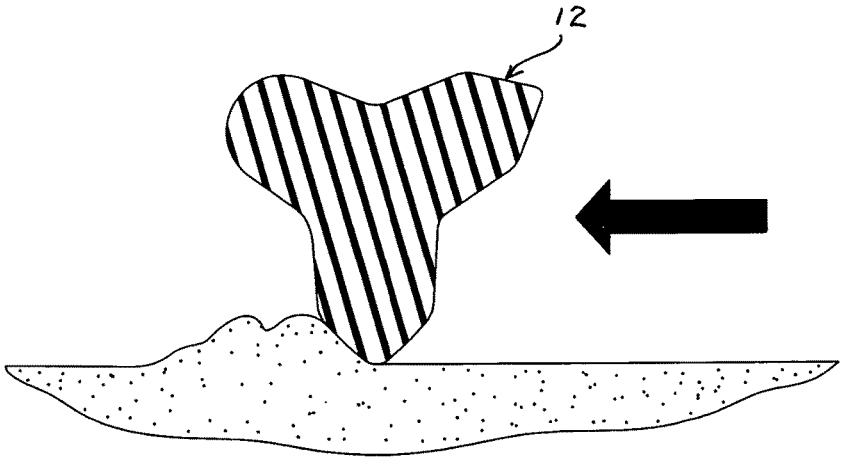
FIG. 8 is a sectional view of the instrument as such is drawn across the skin of a patient illustrating schematically how the surface of the instrument may manipulate the patient's skin.
Figure 9:
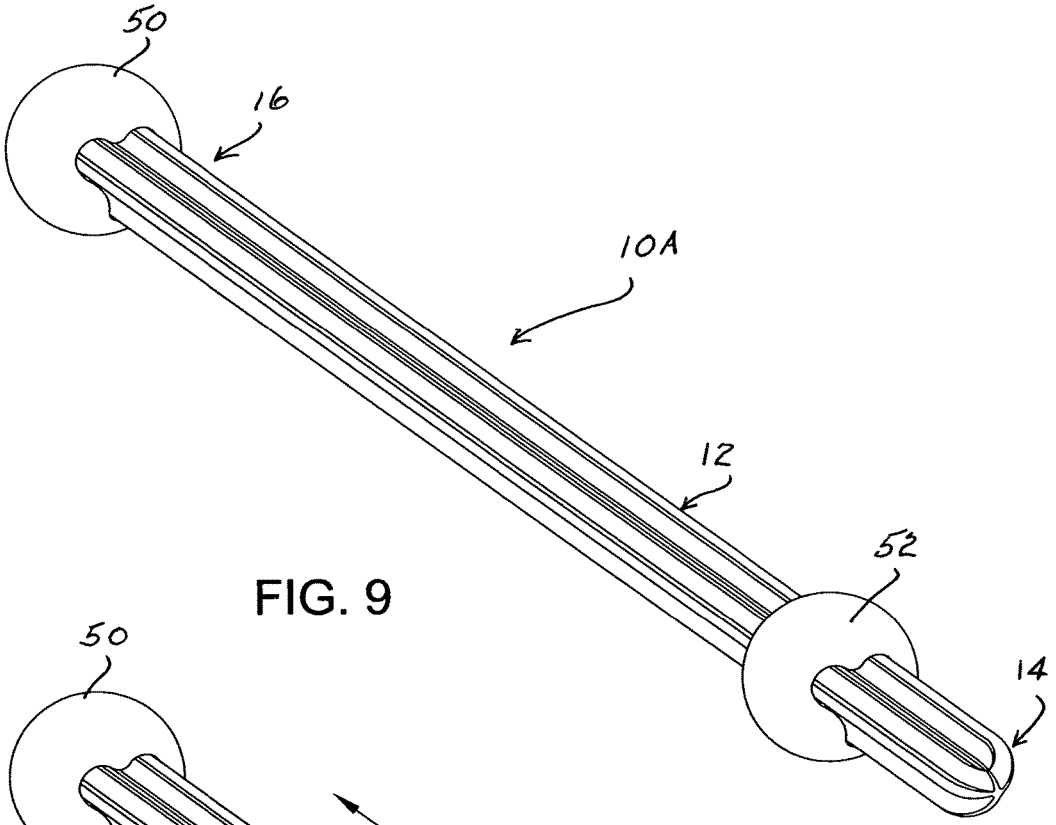
FIG. 9 is a front perspective view of another form of the instrument of the present invention.
Figure 10:
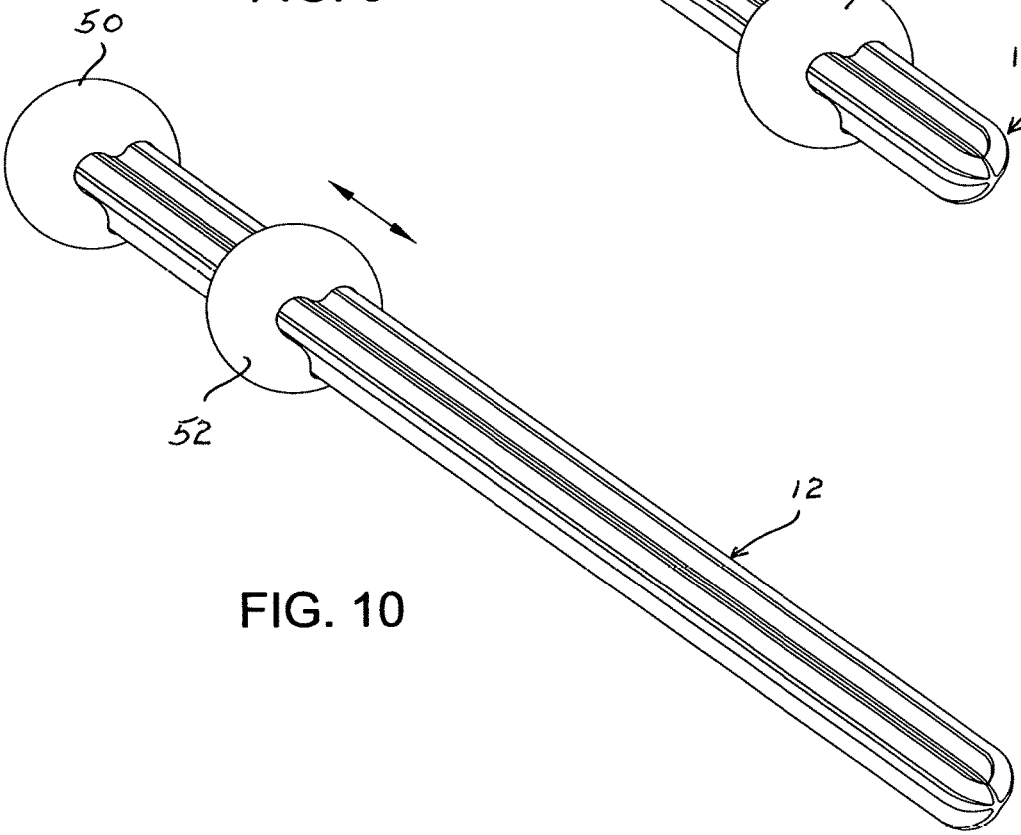
FIG. 10 is a view similar to FIG. 9 but with one of the spherical members positioned thereon in an alternate position.

Turning now to FIGS. 9 and 10 of the drawings, a modified form of the invention is depicted. Therein, an instrument or device 10A includes an elongated body 12 essentially configured the same as that shown in FIGS. 1-8 but provided with a ball 50 fixedly positioned at the second end 16 and a second ball 52 slidably positioned along the body 12 proximate to the first end 14 thereof. In the position shown in FIG. 9, the balls 50, 52 form handles by which the clinician can better manipulate the device especially when performing major back and forth movement of the device 10A across a major body area of a patient, e.g., a thigh, as shown in FIG. 6. In addition, the proximate position of the ball 52 from the first end 14 enables the clinician to cradle the ball 52 in his/her palm while targeting small areas of the patient's skin for pressure treatment via application of force of the smooth rounded end of the first end 14 to the area as by application of force thereto by the clinician's thumb (see FIG. 7). In addition, one or both of the balls 52 may be provided with a flat surface similar to surface 44 of disc 40 and for the same purpose.

Various manners in which the device 10, 10A of the present invention may be utilized to affect mobilization/massage to various area of a patient's body are set forth below.

The device of the present invention is a flexible instrument used for soft tissue mobilization and is constructed from polyurethane rubber. The instrument can be constructed from softer or harder durometer material depending on the desired flexibility of the unit and how the clinician wants the instrument to react on the soft tissue being treated. There are also many other materials that the device could be constructed from in addition to polyurethane. The instrument is flexible and not rigid and can be easily bent and shaped to conform to a variety of different body contours.

The instrument's thickness may vary depending on the treatment goals and the body part being treated. Two different instrument sizes have been constructed—one version is larger and has more girth than the other version. The thicker or larger instrument measures approximately 1.5 inches in height when lying flat on a table and is used for treating larger body parts such as the low back, hamstring, quadriceps etc. The smaller instrument has less girth measuring 1.0 inch in height when lying flat on a table and generally has greater flexibility than the larger instrument due to the reduced girth. The smaller 1.0-inch instrument is used for treating areas with more contours such as the foot, ankle, knee, hand and wrist, etc. Both instruments can be constructed from different durometer urethane. The higher the durometer the harder, more rigid and less flexible the body of the instrument given that both the smaller and larger instruments are of the same thickness. For instance, an 80-durometer instrument version is softer and more flexible than an instrument constructed of 90-durometer polyurethane. The softer durometer material can be used over bony areas of the body that are more sensitive to reduce the force and penetration into the tissue when beginning treatment. The softer durometer material can also be used to conform more easily to the contour of the body part being treated and to provide better grip and traction on the soft tissue.

The instruments may be 18 inches long but could be longer or shorter depending on the treatment goals and the body part being treated. The instrument's body has different treatment edges. Three of the edges run along the longitudinal axis of the instrument and may be 17 25 inches long. The first treatment edge 18 is the dullest, edge 20 is a moderate treatment edge and edge 20 is the sharpest treatment edge. Each edge is created from sides that are 90 degrees opposed to one another, but this could vary depending on the treatment goals and the body part being treated. The number of edges can vary from a single edge to four or more edges depending on the size constraints of the instrument although the three edges shown is the preferred form. Edge measurements may also vary depending on the desired level of penetration into the soft tissue and by the number of edges the instrument contains. The instrument can also be constructed with a thickness taper along its length allowing the instrument to be thick on one end and thinner on the opposite end.

Each end of the instrument has additional treatment tools and edges. The butt end is constructed with either a disc 40 or a ball. The outer circumference of the disc is approximately 1⅜ inches in diameter on the smaller device and 2 inches in diameter on the larger device. The disc can be used for increasing the depth of penetration into the soft tissue later in treatment. The disc can also be used on body areas such as the extremities in which the disc matches the contour of the surface being treated. The butt end can also be constructed with a ball. The ball end can be used to increase depth of penetration when performing pushing and pulling elongation strokes. A second ball can also be added to the device. This second ball is able to slide along the device's body and be positioned anywhere along the instrument's length thereof.

The device can have a disc on one end and a positional ball along the shaft. The slidable or positional ball may also have a flat area to be used as a treatment edge. When two balls or a ball and disc are utilized, such can also be used as grips to hold the device when using one of the longitudinal edges for treatment.

The device also has a smaller rounded end at one end or tip. The tip is formed by rounding over each of the three longitudinal treatment edges 90 degrees until they form a smooth intersection with each other. The tip has three different rounded edges each with the same chamfer as the edge from which that tip was formed and can be used to treat smaller body areas such as the foot, ankle, hand, wrist and elbow etc. The rubber construction material will provide for a less painful treatment over superficial bony areas.

The urethane material and surface, which is smooth but not highly polished, has a higher coefficient of friction than most instrument-assisted soft-tissue mobilization (IASTM) tools and provides the instrument with a good grip on the soft tissue being treated. This traction allows for mobilization and manipulation of the soft tissue in many different directions. When the instrument is bent over or around soft tissue, the tissue may be mobilized in functional radial directions using pulling and pushing motions.

When the skin is lubricated, the instrument smoothly glides over the soft tissue. The instrument is then used as a scraper to break up adhesions and restore soft tissue function. The different edges will allow for varying depth of penetration into the soft tissue depending upon the amount of downward pressure exerted on the instrument.

Strokes:

1. Sliding or scraping stroke: Lotion is applied on the skin over the area to be mobilized. With the sliding or scraping stroke, the instrument moves over the skin scraping the soft tissue area being mobilized. One of the edges of the instrument is chosen for treatment. It is recommended to begin with the dullest edge and work up to the sharper edges over time as the tissue becomes less sensitive and moves more freely. A stroking motion with the device edge sliding over the soft tissue area to be mobilized with light initial pressure is used. In this way, the device will allow the clinician to feel any inconsistencies in the soft tissue. Potentially, these are fibrotic areas that will need to be treated. Gradually increase pressure as the tissue becomes less sensitive. Never mobilize with a level of pressure that causes moderate pain or greater to the patient. When using a sliding stroke, the body edge being used can remain in constant contact with the skin while treating a section of soft tissue. Treatment over a specific area will usually take approximately two minutes or less.
2. Stationary stroke: No lotion is needed on the skin for a stationary stroke. The device is a rubberized instrument that has a high coefficient of friction. When dry, under pressure and in contact with the skin's surface, the instrument will not slide. One of the edges is chosen for treatment. It is recommended to begin with the dullest edge and work up to the sharper edges over time as the tissue becomes less sensitive and moves more freely. A stroking motion with the edge moving over the soft tissue area to be mobilized with light initial pressure is used. The downward pressure exerted over the edge of the device will provide traction on the soft tissue so that the device remains stationary on the skin during treatment but moves with the skin and directly over the soft tissue being mobilized and treated. In this way, the instrument will enable the clinician to feel any inconsistencies in the soft tissue under the skin. Potentially, these are fibrotic areas that will need to be treated. Gradually increase pressure as the tissue becomes less sensitive. Never mobilize with a level of pressure that causes moderate pain or greater to the patient. Treatment over a specific area will usually take approximately 10-60 seconds. Once an area has been treated with a stationary stroke, the device is lifted off the skin and moved to a different area to be treated. Treatment with a stationary stroke requires multiple repositioning of the device in order to treat an area of soft tissue. The stationary stroke can be used with the device either directly on the skin or on a towel directly over the skin if the patient's skin becomes moist.
3. Pulling and pushing-elongation strokes: No lotion is needed on the skin for a pushing or pulling elongation stroke. Because the instrument is of a rubber-type material that has a high coefficient of friction, the instrument will not slide when dry, under pressure and in contact with the surface of the skin so as to provide traction on the soft tissue thereof. These characteristics are used to break down scar tissue and mobilize the soft tissue in order to reset the underlying soft tissue into the correct movement tract. Scaring and fibrosis can alter the position in which in soft tissue moves and thus not allow optimal function. The device can be used to break down these fibrotic areas that alter the functional positioning of the soft tissue. It is recommended to begin with the dullest edge and work up to the sharper edges over time as the tissue becomes less sensitive and moves more freely. The clinician may also want to use the flatter area between two of the treatment edges for a pushing or pulling stroke. A pulling or pushing motion is used with the instrument's edge remaining stationary over the skin of the soft tissue being mobilized. Downward pressure is exerted with the hand holding the device onto the soft tissue. The opposite hand grips the device and uses a sustained pushing or pulling stroke on the device to free up the underlying soft tissue. The time of each stroke may vary from 10 seconds to a minute depending upon the quality of the underlying soft tissue. It is recommended to begin with the flat or the dullest edge with light downward and cross pressure while holding the pushing or pulling stroke for a sustained time of 10 to 60 seconds. Once movement in the soft tissue begins to be restored, higher pressure may be used over a shorter time period. The soft tissue must be mobilized using pushing and pulling strokes in all directions including medial to lateral, longitudinal, rotational and diagonal in order to allow the soft tissue to reset itself into its normal movement patterns.

The ball end can also be used for an elongation stroke to increase depth of penetration later in treatment. The ball will help to improve traction on the soft tissue when either pushing of pulling. Using two balls positioned next to one another will increase the level of traction. Position the ball directly over the soft tissue being treated. With the palm of the hand, the clinician performing the treatment applies downward pressure directly over the ball. The opposite hand holds the device towards the end of its shaft and provides a pushing or pulling movement affecting the ball on the soft tissue. The ball will increase grip and pressure on the soft tissue and serve as an effective elongation tool. If the patient's skin becomes moist, a towel may be used between the device and the skin.

4. Ultramobilization with function:

Active Elongation: The device may be used to hold soft tissue in a certain position while the patient actively moves through a range of motion in a joint above or below where the tissue is being held. The soft tissue that is being held is connected through its attachments to the joint that is being moved. In this way, the patient's active movement acts to help mobilize the soft tissue. The clinician could also use a sliding or scraping stroke as the patient is moving through a partial or full range of motion.

Treatment method:

Warm up before treatment for 5-10 min to warm tissue using a UBE, DB, T band, treadmill, bike, walk, run, body weight squats, knee extension exercises, theraputty, etc. that causes light to mild sweating before treatment. This will help by elevating muscle temperature causing vasodilation and increased blood flow through the tissue and decrease muscle tissue viscosity. These changes will help make the soft tissue easier to mobilize.

Instruct the patient to relax and not tighten up while working on an area. Tension in the tissue being treated will prevent the instrument from penetrating into the deeper layers of soft tissue.

In the beginning of each treatment use a light stroke to warm up the soft tissue.

The goal is to decrease tension, mobilize the soft tissue in all directions and begin the process of breaking up all existing restrictions.

Treat all adjacent areas of the body that are affected. It is important to note that adjacent anatomic areas are usually restricted and must be treated. This assures thoroughness and continuity in the treatment process. When treating the patella tendon and patella femoral joint, one would also examine and treat the quadriceps, adductors, and hamstring muscle groups if necessary.

Use the stroke that works best for the patient's condition being treated.

Flexible instrument Assisted Soft Tissue Mobilization using the device can be performed once or twice a week on a patient. The soft tissue must be given time to remodel after a treatment. Allow a minimum of 48-72 hours between treatments. This will depend on the intensity of the previous and current treatment. Wait until the patient has no pain over the tissue area previously treated. Time between treatments will ultimately be determined by the clinician, patient, any possible precautions that exist and the advice of a licensed medical professional.

After mobilization, active and static flexibility exercises followed by therapeutic exercises to activate the treated soft tissue may be advised by the clinician.

Cryotherapy may also be indicated on painful soft tissue areas at the completion of the treatment session to reduce any inflammation or soreness caused by mobilizing the tissue.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An instrument hand manipulable by a clinician for the mobilization and massage of a soft tissue of a human body, said instrument comprising an elongated generally straight body having opposite terminal first and second ends, said body having a plurality of straight longitudinally extending working edges disposed around said body and spaced generally radially equal to each other, said working edges extending outwardly in profile from said body, said working edges continuously extending between said terminal ends and wherein at least one of said working edges is in part defined by a connection of relatively flat chamfered surfaces, said instrument including said body and said working ends and said terminal ends are integrally molded from a single hard but relatively flexible material with a high surface coefficient friction such that the body is configured to be bent to a generally U-shaped configuration bend when said ends are configured to be grasped and downwardly bent by the clinician such that said bend is configured to conform to a configuration of a body part of a patient being manipulated such that said working edges are configured to contact said body part of the patient being manipulated such that at least one of said working edges contacts and places the skin and soft tissue of said body part in traction by contact with at least one of said working edges and chamfered surfaces such that the clinician can sense any inconsistencies under the skin and which subsequently are to be massaged by a movement of the instrument across the body part surface by the clinician.

2. The instrument of claim 1, said body formed of an elastomeric material.

3. The instrument of claim 2, said elastomeric material having an A scale durometer of between 60 and 100.

4. The instrument of claim 2, said elastomeric material is polyurethane.

5. The instrument of claim 1, said body including three of said longitudinally extending working edges disposed around said body and spaced approximately 120 degrees from each other, said edges varying from sharp to rounded so as to present a variety of treatment surfaces for the use of the clinician.

6. The instrument of claim 5, said working edges merging in rounded terminal portions at said first body end.

7. The instrument of claim 1, said body second terminal end terminating in a first rigid spherical ball element and said body further including a second rigid spherical ball element, said second rigid speherical ball element slidable to alternate positions longitudinally along said body, and wherein both of said rigid spherical ball elements are configured to be non-rotatably positioned on said body.

8. The instrument of claim 1, wherein each of said working edges further defining an intermediate depression extending alongside and between adjacent working edges.

* * * * *